US010727556B2

(12) United States Patent
Kwak et al.

(10) Patent No.: US 10,727,556 B2
(45) Date of Patent: Jul. 28, 2020

(54) MULTIMODE MICROWAVE FILTER

(71) Applicant: Electronics and Telecommunications Research Institute, Daejeon (KR)

(72) Inventors: Changsoo Kwak, Daejeon (KR); In Bok Yom, Daejeon (KR); So-hyeun Yun, Daejeon (KR); Hongyeol Lee, Sejong-si (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 25 days.

(21) Appl. No.: 16/165,433

(22) Filed: Oct. 19, 2018

(65) Prior Publication Data

US 2019/0252748 A1 Aug. 15, 2019

(30) Foreign Application Priority Data

Feb. 13, 2018 (KR) ..... 10-2018-0017907
Apr. 26, 2018 (KR) ..... 10-2018-0048354

(51) Int. Cl.
*H01P 1/208* (2006.01)
*H01P 7/06* (2006.01)

(52) U.S. Cl.
CPC ..... *H01P 1/2082* (2013.01); *H01P 7/06* (2013.01)

(58) Field of Classification Search
CPC ..... H01P 1/208; H01P 1/2086; H01P 1/2082; H01P 1/2084; H01P 1/207
USPC ..... 333/202–209, 219, 219.1, 222–233
See application file for complete search history.

(56) References Cited

U.S. PATENT DOCUMENTS 6,433,652 B1 8/2002 Hattori et al.
2013/0093539 A1* 4/2013 Hedemaki ..... H01P 1/2053 333/203
2013/0249651 A1* 9/2013 Wu ..... H01P 7/10 333/202
2014/0320239 A1 10/2014 Park et al.
2016/0294030 A1 10/2016 Kwak et al.
2017/0033424 A1 2/2017 Kwak et al.

FOREIGN PATENT DOCUMENTS

KR 1020170014828 A 2/2017

* cited by examiner

*Primary Examiner* — Rakesh B Patel
*Assistant Examiner* — Jorge L Salazar, Jr.
(74) *Attorney, Agent, or Firm* — William Park & Associates Ltd.

(57) ABSTRACT

Disclosed is a multimode microwave filter including a resonator in which a cavity is formed to generate a resonant mode and a plurality of irises formed on a side surface of the resonator, in which the cavity of the resonator has a rhombus-shaped cross section.

11 Claims, 9 Drawing Sheets

MULTIMODE MICROWAVE FILTER

CROSS-REFERENCE TO RELATED APPLICATION(S)

This application claims the priority benefit of Korean Patent Application No. 10-2018-0017907 filed on Feb. 13, 2018, and Korean Patent Application No. 10-2018-0048354 filed on Apr. 26, 2018, in the Korean Intellectual Property Office, the disclosures of which are incorporated herein by reference for all purposes.

BACKGROUND

1. Field

One or more example embodiments relate to a microwave filter used for all broadcasting or communication systems.

2. Description of Related Art

A technical field of microwave filters has highly advanced. Recent research on microwave filters focuses on reducing a size and a weight of a filter, minimizing an insertion loss, improving frequency selectivity at a passband boundary, and minimizing a group delay. The research focuses also on setting a bandwidth to be extremely wide or extremely narrow.

The most general one among these methods in such research is reducing a size and a weight of a filter. Recently, a method of using a dielectric with a high dielectric constant has been used to reduce a size and a weight of a filter while reducing an insertion loss. In addition, another method of allowing a single resonator to function as multiple resonators by generating multiple resonances without generating a single resonance in individual resonators included in a filter has also been used to reduce a size and a weight of a filter. In general, this latter method may be simpler than the former method using the dielectric. In addition, the method may be more effective in reducing a size and a weight of a filter by increasing the number of resonances.

Multimode filter-related existing methods may include, for example, using two types of multimode filter to generate a multimode by inserting a dielectric and change stepwise a shape of the inserted dielectric to be an asymmetrical shape. However, such methods of generating a multimode using a dielectric may not be effective in that producing a dielectric and fixing it into a cavity accurately and stably may not be easy and the dielectric may be heavy, and costs for producing a filter may increase.

SUMMARY

An aspect provides a microwave filter that may generate a multimode by adjusting a shape of a cavity and allowing, to be closer to each other, different resonant frequencies of two modes generated in a single cavity and may thus obtain a wide bandwidth.

Compared to existing multimode filters, the microwave filter may be simpler in shape without using a dielectric and may thus be reduced in size and weight, and it is thus possible to save costs for producing the microwave filter and facilitate the production.

According to an aspect, there is provided a microwave filter including a resonator in which a cavity is formed to generate a resonant mode, and a plurality of irises formed on a side surface of the resonator. The cavity of the resonator may have a rhombus-shaped cross section.

An aspect ratio of a longitudinal section of the cavity of the resonator may be adjusted.

The longitudinal section may be a section in a direction parallel to the side surface of the resonator.

A length of a side in a horizontal direction of the longitudinal section may be smaller than a length of a side in a vertical direction of the longitudinal section.

A cylindrical cavity may be formed at each vertex of the resonator.

The microwave filter may be a bandpass filter.

According to another aspect, there is provided a microwave filter including a first resonator in which a first cavity is formed, a second resonator in which a second cavity is formed, and a plurality of irises formed on side surfaces of the first resonator and the second resonator. Each of the first cavity and the second cavity may have a rhombus-shaped cross section.

An aspect ratio of a longitudinal section of each of the first cavity and the second cavity may be adjusted.

The longitudinal section may be a section in a direction parallel to a side surface of a corresponding resonator.

A length of a side in a horizontal direction of the longitudinal section may be smaller than a length of a side in a vertical direction of the longitudinal section.

A cylindrical cavity may be formed at each vertex of the first resonator and the second resonator.

The microwave filter may further include a tuning screw to be inserted into at least one of the first cavity or the second cavity.

The microwave filter may be a bandpass filter.

The first resonator and the second resonator may be connected in series.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which.

DETAILED DESCRIPTION

Figure 1:
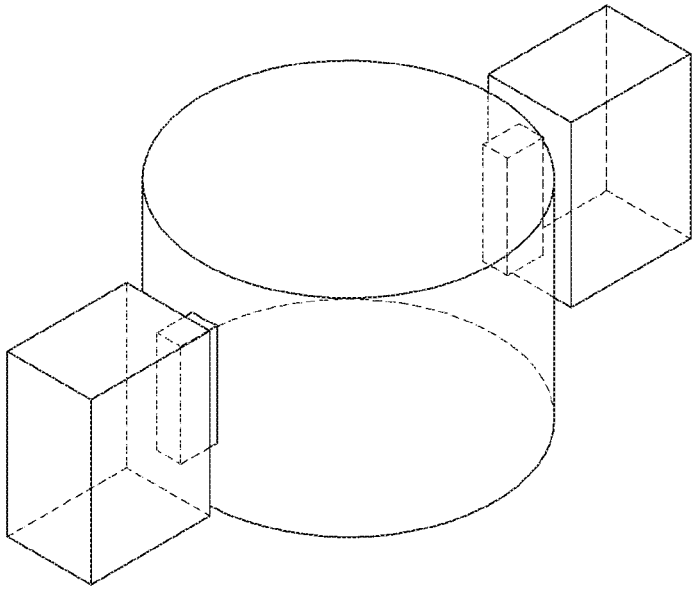
FIG. 1 RELATED ART
FIG. 1 is a perspective view of an example of a cylindrical resonant filter according to an example embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, operations, elements, and/or components, but do not preclude the presence or addition of one or more other features, integers, operations, elements, components, and/or to groups thereof.

Terms such as first, second. A. B. (a), (b), and the like may be used herein to describe components. Each of these terminologies is not used to define an essence, order, or sequence of a corresponding component but used merely to distinguish the corresponding component from other component(s). For example, a first component may be referred to as a second component, and similarly the second component may also be referred to as the first component.

It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings.

Figure 2:
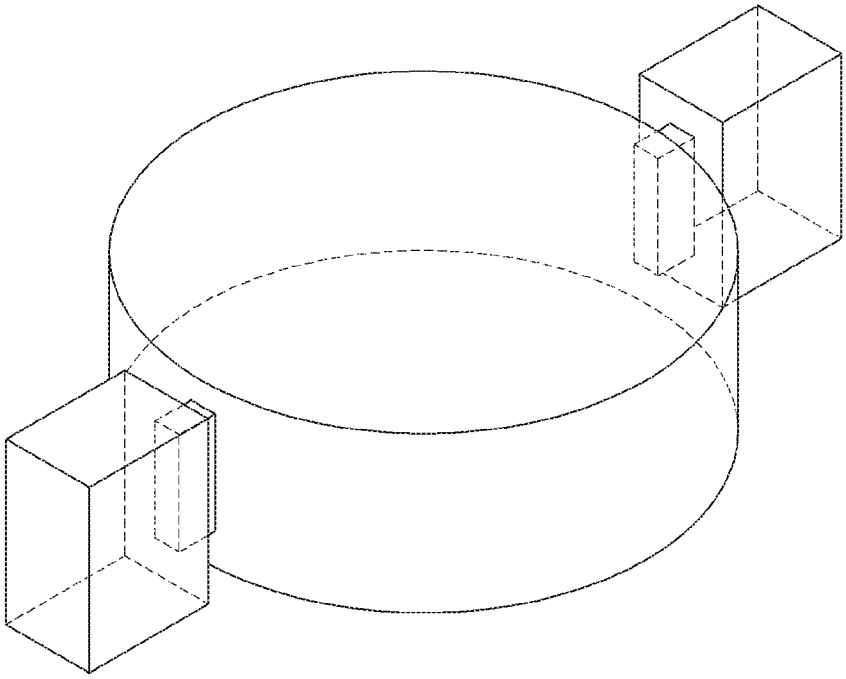
FIG. 2 RELATED ART
FIG. 2 is a perspective view of another example of a cylindrical resonant filter according to an example embodiment.

FIG. 1 is a perspective view of an example of a cylindrical resonant filter according to an example embodiment, and FIG. 2 is a perspective view of another example of a cylindrical resonant filter according to an example embodiment.

Referring to FIGS. 1 and 2, a cylindrical resonant filter may be provided in a structure in which a cylindrical cavity is formed and a slot-shaped iris is combined in an axial direction thereof.

A basic mode of such a cylindrical resonant filter combined with the slot-shaped iris in the axial direction is transverse electric (TE) 111 mode. As a frequency increases, the mode includes TE211 mode, TE011 mode, and TE311 mode.

The TE011 mode may be generally used to use a high quality factor. However, a frequency difference between the TE011 mode and the TE211 mode is smaller than a frequency difference between the TE011 mode and the TE311 mode. A frequency difference between the TE211 mode and the TE311 mode may be similar to the frequency difference between the TE011 mode and the TE211 mode.

The frequency differences may be adjusted to maintain a resonant frequency to a certain level by decreasing and increasing a diameter and a height of the cylindrical cavity, respectively, or increasing and decreasing the diameter and the height, respectively, and namely, by adjusting an aspect ratio, or a diameter/height of a resonator. By increasing the diameter of the cylindrical resonant filter and decreasing the height thereof, a frequency difference between resonant modes may be reduced.

FIG. 2 illustrates a flat-type cylindrical resonant filter with a large aspect ratio compared to the cylindrical resonant filter illustrated in FIG. 1.

Figure 3:
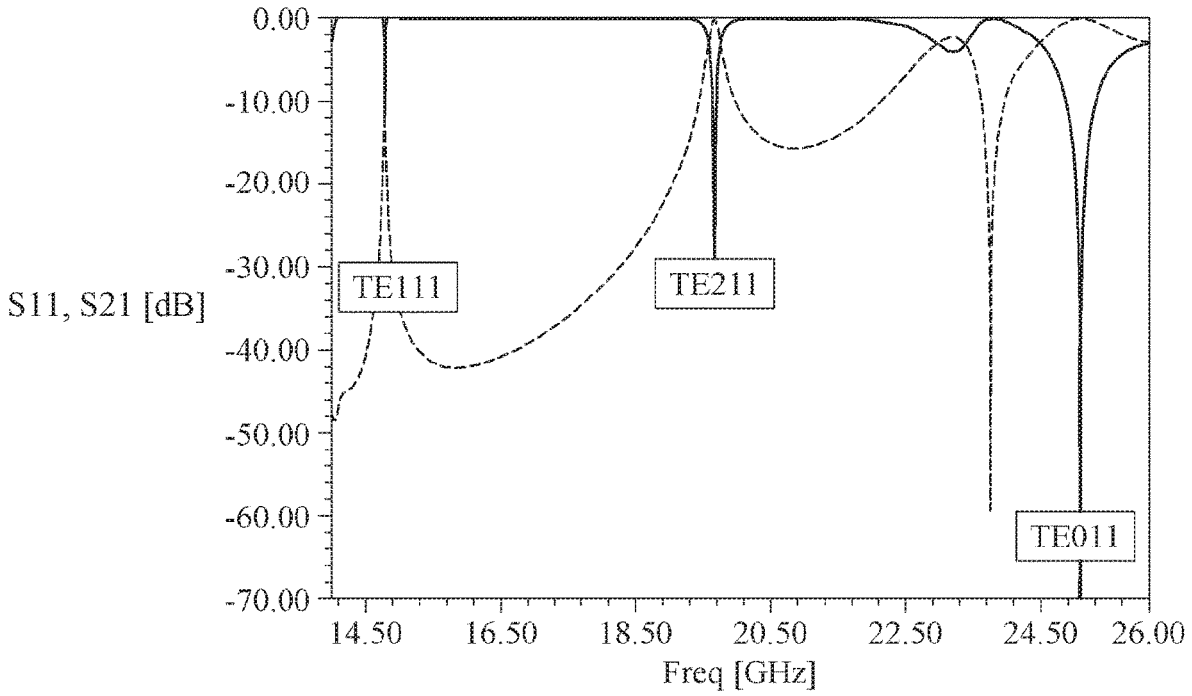
FIG. 3 RELATED ART
FIG. 3 is a graph illustrating a characteristic of the cylindrical resonant filter illustrated in FIG. 1.
Figure 4:
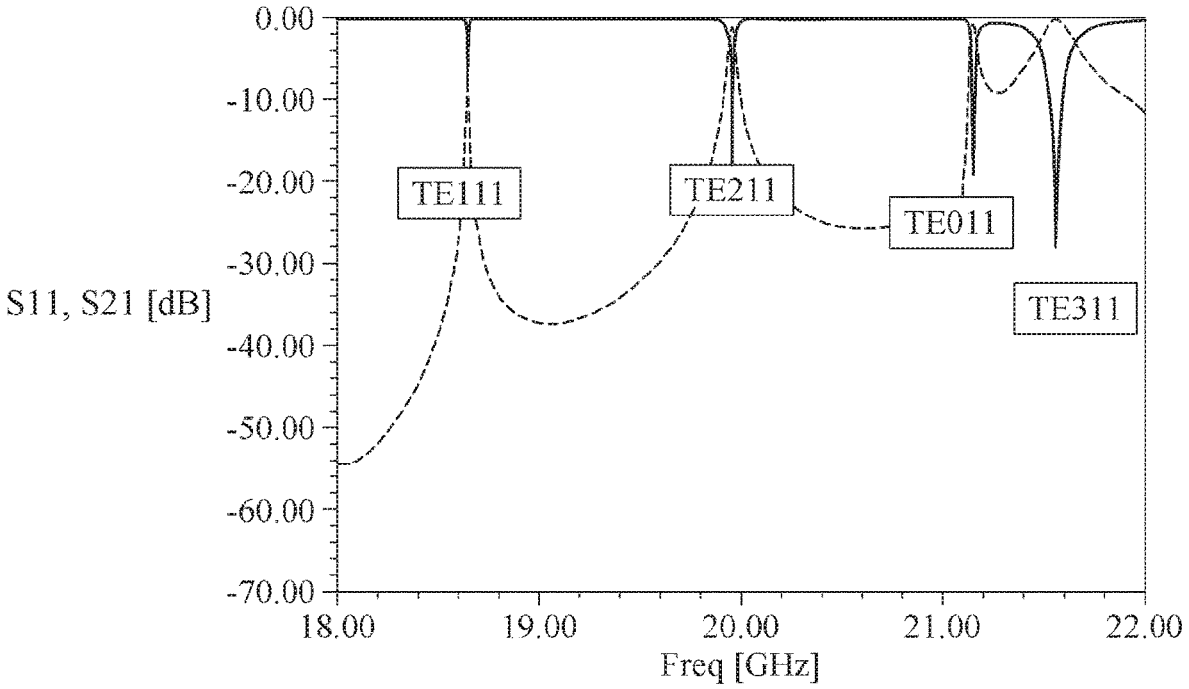
FIG. 4 RELATED ART
FIG. 4 is a graph illustrating a characteristic of the cylindrical resonant filter illustrated in FIG. 2.

FIG. 3 is a graph illustrating a characteristic of the cylindrical resonant filter illustrated in FIG. 1, and FIG. 4 is a graph illustrating a characteristic of the cylindrical resonant filter illustrated in FIG. 2.

Referring to FIG. 3, TE111 mode, TE211 mode, and TE011 mode are shown in a frequency range between 14.5 gigahertz (GHz) to 26.0 GHz. Referring to FIG. 4, dissimilar to the example illustrated in FIG. 3, TE111 mode, TE211 mode, TE011 mode, and TE311 mode are shown in a frequency range between 18 GHz and 22 GHz. It is verified that a bandwidth of the TE011 mode of FIG. 4 is significantly narrower than that of the TE011 mode of FIG. 3.

That is, as an aspect ratio of a cylindrical resonant filter increases, resonant frequencies of respective modes may become closer to each other, and a bandwidth of each mode may become narrower.

For example, a frequency interval between the TE111 mode and the TE211 mode is 4.836 GHz as illustrated in FIG. 3, and a frequency interval between the TE111 mode and the TE211 mode is 1.129 GHz as illustrated in FIG. 4. A frequency difference between two modes may be greatly reduced by increasing an aspect ratio. However, by increasing further the aspect ratio, the two modes may not be combined into a single bandwidth and a final bandwidth may become significantly narrow because a bandwidth of each mode is significantly reduced.

Thus, using the cylindrical resonant filter may not embody a dual mode filter, for example, a multimode filter, that may use the TE111 mode and the TE211 mode in a single bandwidth.

Figure 5:
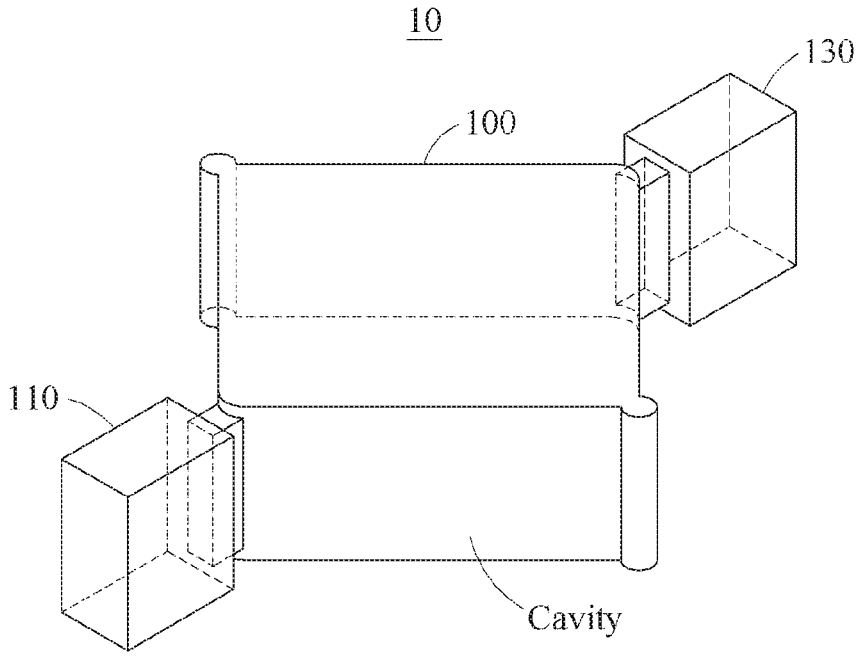
FIG. 5 is a perspective view of an example of a microwave filter according to an example embodiment.
Figure 6:
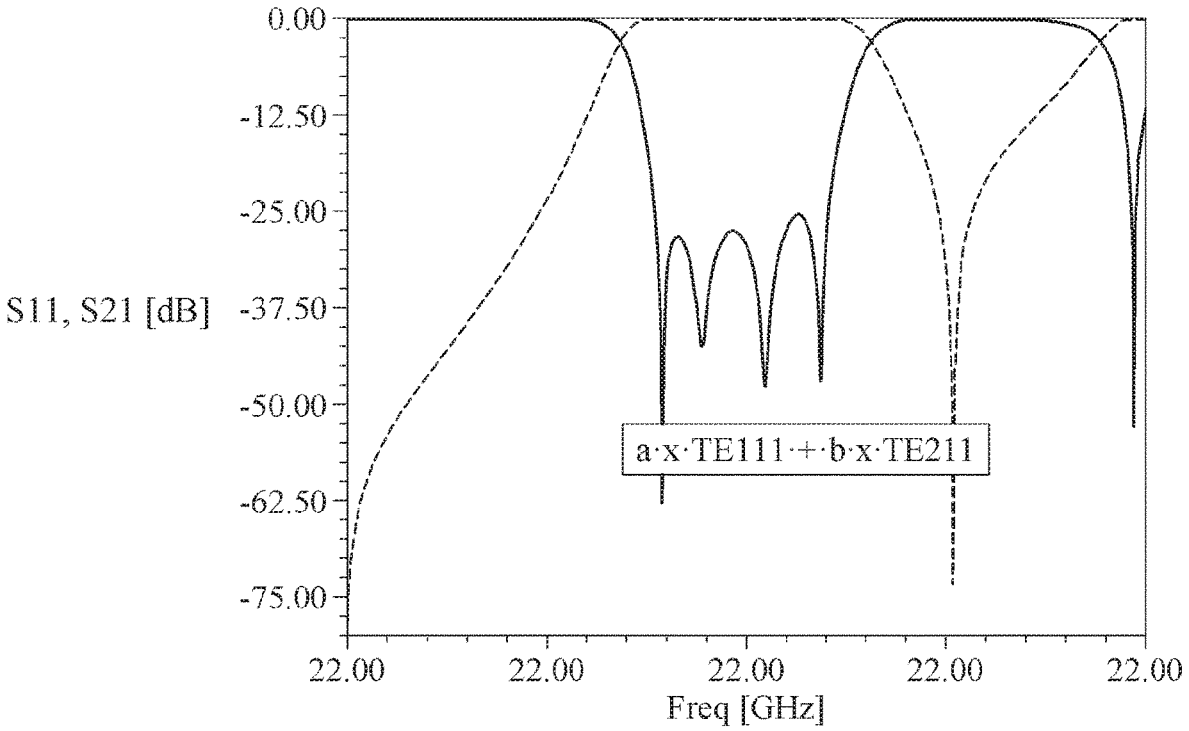
FIG. 6 is a graph illustrating a characteristic of the microwave filter illustrated in FIG. 5.
Figure 7:
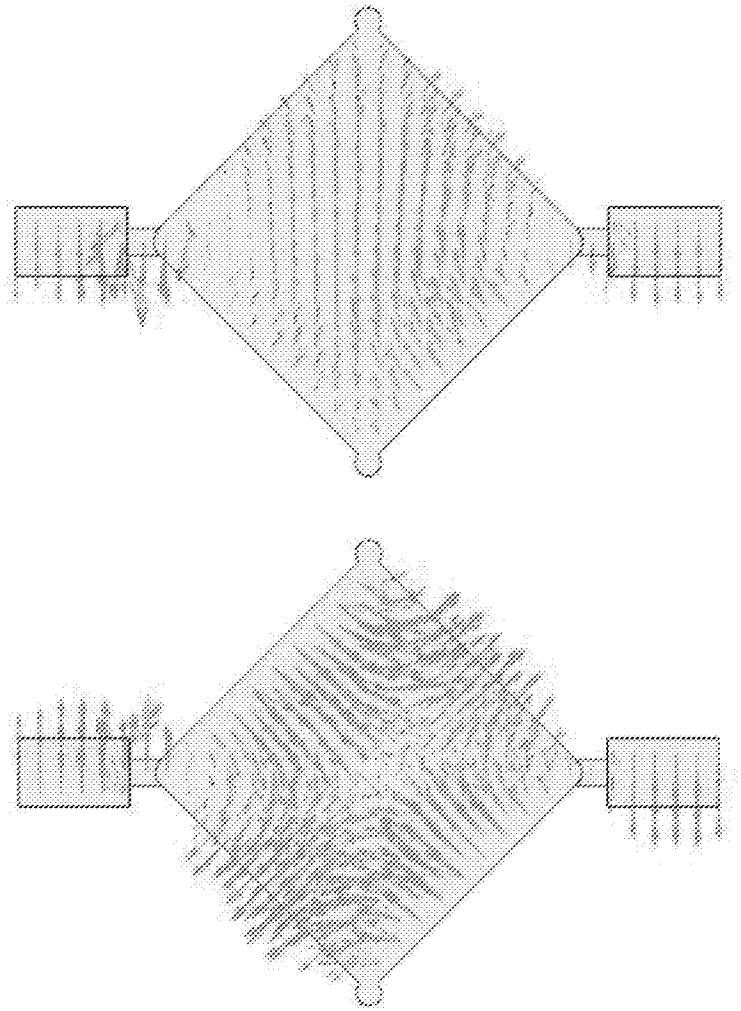
FIG. 7 is a diagram illustrating an example of a reflection zero-based characteristic, or an electric field distribution, of FIG. 6.

FIG. 5 is a perspective view of an example of a microwave filter according to an example embodiment. FIG. 6 is a graph illustrating a characteristic of the microwave filter illustrated in FIG. 5. FIG. 7 is a diagram illustrating an example of a reflection zero-based characteristic, or an electric field distribution, of FIG. 6.

Referring to FIGS. 5 through 7, a microwave filter 10 includes a resonator 100 in which a cavity used to generate a resonant mode is formed, and a plurality of irises 110 and 130.

The microwave filter 10 may be used in all broadcasting or communication systems. The microwave filter 10 may be a bandpass filter with a significantly wide passband.

A plurality of resonant modes having a plurality of resonant frequencies may be generated in the cavity of the resonator 100. For example, the resonant modes may include a first mode having a first resonant frequency and a second mode having a second resonant frequency. In this example, the first mode may be TE111 mode and the second mode may be TE211 mode.

The microwave filter 10 may be combined with input and output ports using the irises 110 and 130. Respective lengths of the irises 110 and 130 may be equal to or different from each other.

The irises 110 and 130 may be used as an input iris and an output iris, respectively. For example, when the iris 110, which is also referred to as a first iris, is the input iris, and the iris 130, which is also referred to as a second iris, is the output iris, the first iris 110 may be connected to the input port and the second iris 130 may be connected to the output port.

The input port and the output port may be reversed. For example, when the first iris 110 is the output iris and the second iris 130 is the input iris, the first iris 110 may be connected to the output port and the second iris 130 may be connected to the input port.

The cavity of the resonator 100 may be a rhombus-shaped cavity. For example, the cavity may have a rhombus-shaped cross section.

Herein, an aspect ratio of a longitudinal section of the cavity may be adjusted. The aspect ratio of the longitudinal section of the cavity may be low. A length of a side in a horizontal direction of the longitudinal section may be smaller than a length of a side in a vertical direction, or a height, of the longitudinal section. For example, the longitudinal section of the cavity may indicate a section in a direction parallel to the resonator 100, for example, parallel to a side surface of the cavity.

The resonator 100 of a rhombus shape may have a characteristic similar to that of the cylindrical resonators illustrated in FIGS. 1 and 2. By adjusting an aspect ratio of the rhombus-shaped cavity, resonant frequencies of neighboring modes may become closer to each other.

By adjusting the aspect ratio of the rhombus-shaped cavity, the resonator 100 may allow a resonant frequency of the TE111 mode and a resonant frequency of the TE211 mode to be sufficiently closer to each other. That is, two resonant modes may occur in a single cavity.

In addition, a cylindrical space, or a cavity, may be formed at each vertex of the resonator 100.

Herein, four reflection zeros may be shown as illustrated in FIG. 6. For example, a first reflection zero may be significantly close to the TE111 mode as illustrated in a left portion of FIG. 7, and a fourth reflection zero may be significantly close to the TE211 mode as illustrated in a right portion of FIG. 7. In addition, a second reflection zero and a third reflection zero may have a form of the TE111 mode and the TE211 mode combined.

That is, as illustrated in FIG. 6, four modes may be formed by a linear combination of the TE111 mode and the TE211 mode, and the modes may form a passband. As illustrated in the graph of FIG. 6, a bandwidth is 1.74 GHz and a fractional bandwidth is 8.7%.

As described above, the microwave filter 10 may generate a multimode and obtain a wide bandwidth by adjusting an aspect ratio of a rhombus-shaped cavity and allowing, to be closer to each other, resonant frequencies of two modes having different frequencies that may occur in a single cavity, without using a dielectric. In addition, the microwave filter 10 may be reduced in size and weight, and thus it is possible to reduce costs used to produce the microwave filter 10.

Since a dielectric is not used, it is possible to produce the microwave filter 10 more readily with reduced costs, and reduce a height of the resonator 100 of the microwave filter 10.

Figure 8:
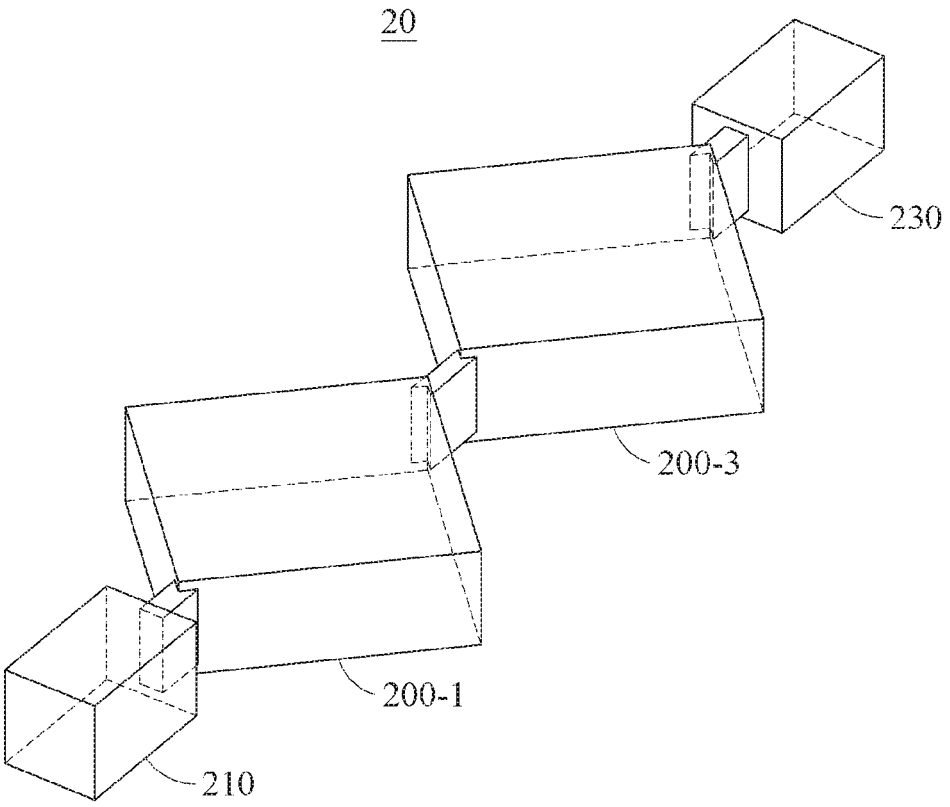
FIG. 8 is a perspective view of another example of a microwave filter according to an example embodiment.
Figure 9:
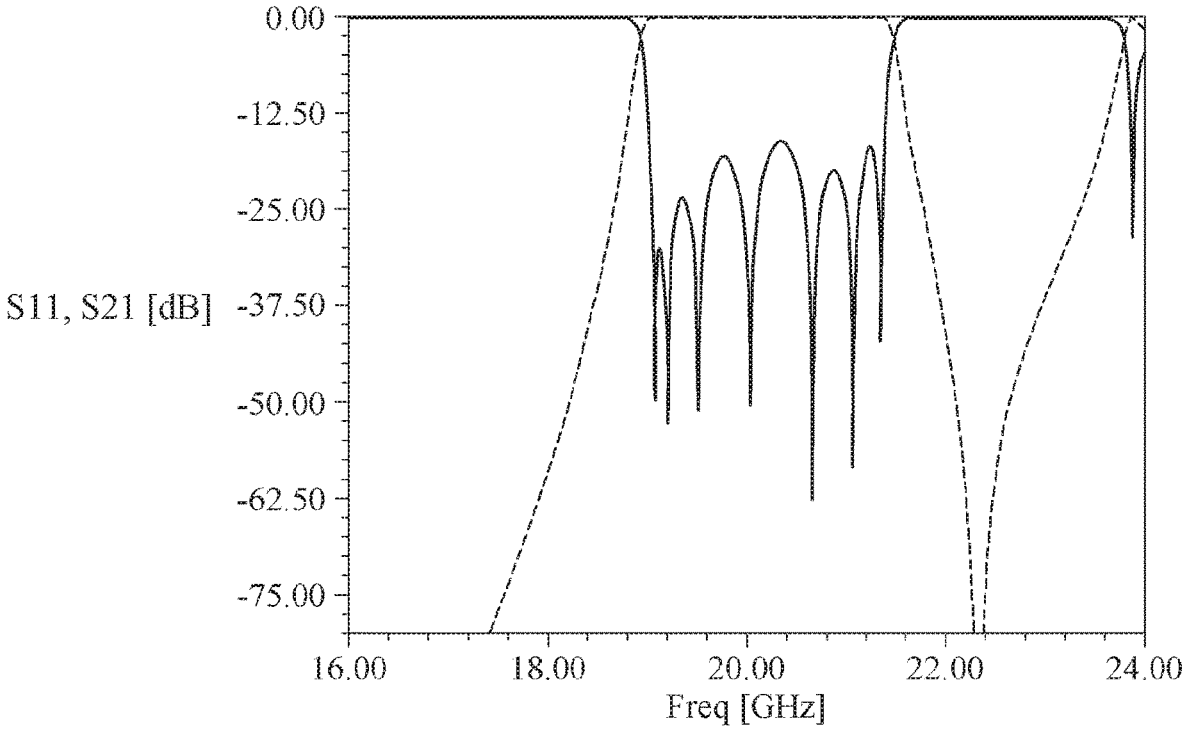
FIG. 9 is a graph illustrating a characteristic of the microwave filter illustrated in FIG. 8.

FIG. 8 is a perspective view of another example of a microwave filter according to an example embodiment, and FIG. 9 is a graph illustrating a characteristic of the microwave filter illustrated in FIG. 8.

Referring to FIGS. 8 and 9, a microwave filter 20 includes a plurality of resonators 200-1 and 200-3 in which a cavity used to generate a resonant mode is formed, and a plurality of irises 210 and 230.

Referring to FIG. 8, dissimilar to the microwave filter 10 illustrated in FIG. 5, the microwave filter 20 may be embodied by using two resonators, for example, the resonators 200-1 and 200-3 as illustrated. The resonators 200-1 and 200-3 may be connected in series based on vertices. The resonators 200-1 and 200-3 and the irises 210 and 230 illustrated in FIG. 8 are substantially the same as the resonator 100 and the irises 110 and 130 illustrated in FIG. 5, and thus a more detailed and repeated description will be omitted here for brevity.

Referring to FIG. 9, seven reflection zeros are shown, and up to eight reflection zeros may be generated by tuning a design further. A reflection zero may be generated further by adding, to each of the resonators 200-1 and 200-1, a cylindrical space formed at a rhombus-shaped vertex as illustrated in FIG. 5, or by inserting a tuning screw into an appropriate position. For example, the tuning screws may be inserted into one or more cavities of the resonators 200-1 and 200-3.

As illustrated in the graph of FIG. 9, a bandwidth is 2.34 GHz and a fractional bandwidth is 11.7%. It is verified that a bandwidth increases by adding a resonator to the microwave filter 20. It is also verified that a roll-off of S21 at a band boundary drops more sharply compared to the example illustrated in FIG. 6.

Thus, a resonator may be added to increase a bandwidth and improve a blocking characteristic at a band boundary.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. A microwave filter comprising:

a resonator in which a cavity is formed to generate a resonant mode; and a plurality of irises formed on a side surface of the resonator, wherein the resonator cavity has a cylindrical cavity at remaining vertices of the resonator other than vertices where the plurality of irises are formed, and wherein the cavity of the resonator has a rhombus-shaped cross section.

2. The microwave filter of claim 1, wherein an aspect ratio of a longitudinal section of the cavity of the resonator is set once manufactured.

3. The microwave filter of claim 2, wherein the longitudinal section is a section in a direction parallel to the side surface of the resonator.

4. The microwave filter of claim 2, wherein a length of a side in a horizontal direction of the longitudinal section is smaller than a length of a side in a vertical direction of the longitudinal section.

5. The microwave filter of claim 1, being a bandpass filter.

6. A microwave filter comprising:

a first resonator in which a first cavity is formed:

a second resonator in which a second cavity is formed; and a plurality of irises formed on side surfaces of the first resonator and the second resonator, wherein the first resonator cavity has a cylindrical cavity at remaining vertices of the first resonator other than vertices where the plurality of irises are formed, wherein the second resonator cavity has a cylindrical cavity at remaining vertices of the second resonator other than vertices where the irises plurality of are formed, and wherein each of the first cavity and the second cavity has a rhombus-shaped cross section.

7. The microwave filter of claim 6, being a bandpass filter.

8. The microwave filter of claim 6, wherein an aspect ratio of a longitudinal section of each of the first cavity and the second cavity is set once manufactured.

9. The microwave filter of claim 8, wherein the longitudinal section of each of the first cavity and the second cavity is a section in a direction parallel to a side surface of a corresponding resonator.

10. The microwave filter of claim 8, wherein a length of a side in a horizontal direction of the longitudinal section of each of the first cavity and the second cavity is smaller than a length of a side in a vertical direction of the longitudinal section.

11. The microwave filter of claim 6, wherein the first resonator and the second resonator are connected in series.

* * * * *